US012631375B2

(12) United States Patent
Matthews

(10) Patent No.: US 12,631,375 B2
(45) Date of Patent: May 19, 2026

(54) HEAT EXCHANGER FOR CRYOGENIC COOLING APPARATUS

(71) Applicant: Oxford Nanoscience Limited, Abingdon (GB)

(72) Inventor: Anthony Matthews, Abingdon (GB)

(73) Assignee: OXFORD NANOSCIENCE LIMITED, Abingdon (GB)

( * ) Notice: Subject to any disclaimer, the term of this patent is extended or adjusted under 35 U.S.C. 154(b) by 198 days.

(21) Appl. No.: 18/282,636

(22) PCT Filed: Feb. 23, 2022

(86) PCT No.: PCT/GB2022/050501

§ 371 (c)(1),
(2) Date: Sep. 18, 2023

(87) PCT Pub. No.: WO2022/200761

PCT Pub. Date: Sep. 29, 2022

(65) Prior Publication Data

US 2024/0167739 A1 May 23, 2024

(30) Foreign Application Priority Data

Mar. 25, 2021 (GB) ..... 2104240

(51) Int. Cl.
*F25B 9/12* (2006.01)
*F25B 40/02* (2006.01)

(52) U.S. Cl.
CPC ..... *F25B 40/02* (2013.01); *F25B 9/12* (2013.01)

(58) Field of Classification Search
CPC ..... F25B 2309/1412; F28D 21/00; F28D 2021/0033; F25D 19/006
See application file for complete search history.

(56) References Cited

U.S. PATENT DOCUMENTS 3,273,356 A * 9/1966 Hoffman ..... F25B 9/02 165/142
3,692,099 A * 9/1972 Nesbitt ..... F28F 27/00 165/10

(Continued)

FOREIGN PATENT DOCUMENTS

EP 3742076 A1 11/2020
EP 3910276 A1 11/2021

(Continued)

OTHER PUBLICATIONS

International Search Report and Written Opinion, mail date Jan. 6, 2022, 15 pages, received in corresponding PCT application No. PCT/GB2022/050501.

(Continued)

*Primary Examiner* — Lionel Nouketcha
(74) *Attorney, Agent, or Firm* — Blank Rome LLP

(57) ABSTRACT

A heat exchanger for a cryogenic cooling apparatus is provided. The heat exchanger has a first conduit, a second conduit and a chamber, wherein the chamber is arranged to receive a fluid from the first conduit, and wherein second conduit is thermally coupled to the outside of the chamber. The chamber has a first region and a second region, the first region separated from the second region by a plate extending through the chamber, the plate comprising one or more apertures for allowing a flow of the fluid from the first region to the second region.

21 Claims, 8 Drawing Sheets

(56) References Cited

U.S. PATENT DOCUMENTS

| | | | | |
|---|---|---|---|---|
| 5,101,894 | A | 4/1992 | Hendricks | |
| 5,189,880 | A | 3/1993 | Frossati et al. | |
| 5,582,245 | A | 12/1996 | Niimi | |
| 2004/0187519 | A1* | 9/2004 | Zhu | F25B 9/10 62/613 |

FOREIGN PATENT DOCUMENTS

| | | |
|---|---|---|
| GB | 1596194 | 8/1981 |
| JP | 200974774 A | 4/2009 |

OTHER PUBLICATIONS

Pobell, Frank, Matter and Methods at Low Temperatures, Spring-Verlag Berlin Heidelberg New York, 2007, Ed. Third ISBN: 10 3-540-46356-9.
Low Temperature Laboratory, printout of web page, Aalto Univeristy—Research Infrastructure Booking System, https://infrabooking.aalto.fi/onlinekalenteri/ltl/guest.php.
Dilution Refrigerators, printout of web page, Aalto University—Research Infrastructure Booking System, https://infrabooking.aalto.fi/onlinekalenteri/ltl/gurest.php.
Prototype, printout of popup window from web page.
Photographs of the Prototype device.
Low Temperature Laboratory, Aalto University School of Science, archived versions of LTL web pages.
Witness statement of Dr. Pertti Hakonen.
Witness statement of Dr. Alexander Savin dated Mar. 3, 2025.
Examination report WO-01085413 of Kiwa inspecta, Dec. 12, 2024, with English translation, Aalto University DRT imaging of heat exchanger arrangement.
Witness statement by Prof. Dr.-Ing Wolfgang Wensdorfer with English translation, dated Feb. 28, 2025.
Witness statement of Dr. Pasi Lähteenmäki, dated Mar. 3, 2025.
Witness statement tof M.Sc. (Tech) Kaur Jaakma dated Mar. 4, 2025.
Witness statement of M.Sc. Pieter Vorselman dated Feb. 28, 2025.
Witness statement of Dr. Tech. David Gunnarsson dated Mar. 4, 2025.
Batey, Graham et al., Principles of dilution refrigeration, A brief technology guide, Oxford Instruments, The Business of Science, published by Oxford Instruments NanoScience, United Kingdom, Oxford Instruments Nanotechnology Tools Limited, 2015.
Notice of opposition to a European Patent received in corresponding patent application No. EP4184082, mail date Mar. 5, 2025.

* cited by examiner

HEAT EXCHANGER FOR CRYOGENIC COOLING APPARATUS

CROSS-REFERENCE TO RELATED APPLICATIONS

This application is a national stage filing of PCT Application No. PCT/GB/2022/050501, filed on Feb. 23, 2022, which claims the benefit of GB Application No. 2104240.3, filed Mar. 25, 2021, both of which are hereby incorporated by reference in their entirety.

FIELD OF THE INVENTION

The invention relates to a heat exchanger for a cryogenic cooling apparatus. In a particularly advantageous implementation, the heat exchanger forms part of a dilution refrigerator.

BACKGROUND

There are a number of applications that require cooling to millikelvin temperatures. Such temperatures can be obtained by operation of a dilution refrigerator. A dilution unit will form part of the dilution refrigerator, the dilution unit comprising a still and a mixing chamber, connected by a set of heat exchangers. An operational fluid formed of a helium-3/helium-4 mixture is circulated around the dilution unit during operation. Cooling is obtained at the mixing chamber from the enthalpy of mixing as helium-3 is diluted into helium-4. The mixing chamber is thereby operable so as to obtain the lowest temperature of any part of the dilution refrigerator. Helium-3 is boiled at the still, which removes energy due to the latent heat of vaporisation. A cold plate is arranged between the still and the mixing chamber and generally obtains a temperature between these two components during use.

The heat exchangers are an important aspect of dilution refrigerator design and are used to couple 'cold' helium-3 leaving the mixing chamber to the 'warm' helium-3 returning to it. The quality of this exchange determines, for example, the minimum temperature attainable. There are essentially two types of heat exchanger in use (on all dilution refrigerators) today, the so called 'continuous' exchanger and the 'step' exchangers.

An example of a prior art dilution unit is shown by FIG. 1. Operational fluid flows between the still 102 and the mixing chamber 105 through two counterflow paths in a heat exchanging unit. The heat exchanging unit comprises a continuous heat exchanger 101 arranged between the still 102 and a cold plate 103. The continuous heat exchanger 101 comprises a coaxial unit arranged in a spiral, through which the two paths proceed in opposite directions, with the inner path surrounded by the outer path in a coiled arrangement (not shown). Continuous heat exchangers can generally be used to obtain temperatures down to around 30 millikelvin. Dilution refrigerators with only continuous heat exchangers are limited to operate at around 30 millikelvin due to the increasing Kapitza (thermal boundary) resistance between liquid helium and metals at low temperatures. At lower temperatures continuous heat exchangers do not provide sufficient surface area to defeat the increasing thermal boundary resistance. Step heat exchangers may be used to obtain yet lower temperatures by using large-surface-area sinters to overcome the Kapitza resistance. Two step heat exchangers 104 are arranged in a stack between the cold plate 103 and the mixing chamber 105. Each step heat exchanger forms a substantially disc-like structure, in which the two paths are separated by a foil. The number of step heat exchangers provided may be selected to suit the application.

In common use there are effectively two geometries of step heat exchanger, the 'counterflow block' and the 'semi-continuous'. For the counterflow block, there are two counterflowing streams of helium-3, thermally coupled by sinters through a supporting medium, which can be a thin membrane. Semi-continuous heat exchangers generally have a coiled geometry similar to that of a continuous heat exchangers. However, the inner conduit is constructed from a set of discrete sintered elements that are jointed together and enclosed within an outer tube. If the outer tube is exposed then the semi-continuous heat exchanger may provide the appearance of a continuous heat exchanger. Alternatively, the outer tube may be housed within welded boxes that provide the appearance of a step heat exchanger.

The assembly of a dilution unit, and in particular the step heat exchangers described above, is typically an intricate and labour-intensive procedure that takes highly trained technicians hundreds of hours to complete. The performance of the dilution refrigerator is sensitive to minor differences in the assembly process, and the high reliance on manual assembly techniques means that the final performance of the dilution refrigerator cannot always be precisely guaranteed in advance. It is desirable to reduce the standard deviation between the performance of heat exchangers and dilution refrigerators manufactured according to a particular process. It is also desirable to provide a simpler method of constructing these devices that is more amenable to automation. The invention is set in the context of solving these problems.

SUMMARY OF THE INVENTION

A first aspect of the invention provides a heat exchanger for a cryogenic cooling apparatus, comprising: a first conduit, a second conduit and a chamber, wherein the chamber is arranged to receive a fluid from the first conduit, and wherein second conduit is thermally coupled to the outside of the chamber, the chamber having a first region and a second region, the first region separated from the second region by a plate extending through the chamber, the plate comprising one or more apertures for allowing a flow of the fluid from the first region to the second region.

The configuration of the heat exchanger lends itself to simpler assembly processes that can be semi or fully automated. The repeatability of the performance of the heat exchanger is therefore improved in comparison with some prior art heat exchangers. The plate is preferably arranged to obstruct a flow of fluid through the chamber. The apertures may hence be arranged with respect to the first conduit so that the fluid follows a non-linear path through the chamber. The second conduit is thermally coupled to the outside of the chamber and so the non-linear path increases the thermal coupling between the fluid from the first conduit that is in the chamber and the fluid in the second conduit.

The chamber may be arranged along the first conduit. In other words, the chamber may be arranged to receive fluid directly from a first portion of the first conduit, and a second portion of the first conduit may be arranged to receive fluid directly from the chamber. The first conduit is typically fluidly coupled to the inside of the chamber at a first position within the first region and a second position within the second region, wherein the one or more apertures are laterally offset from the first position and/or the second position in a direction along the plate. This improves the thermal coupling between the fluid in the chamber and any fluid in the second conduit. The heat exchanger typically comprises a central axis extending through the centre of the chamber, wherein the first conduit is coupled to the chamber at two positions arranged along the central axis. The one or more apertures may therefore be radially dispersed from the central axis. Extending the first conduit along the central axis ensures that the heat exchanger is properly supported and facilitates simpler assembly. The heat exchanger is preferably rotationally symmetric about the central axis. This further simplifies the method of assembly because, for example, if any joints need to be made using a welding process, it may be possible to rotate the heat exchanger about the central axis during this welding process.

The purpose of the heat exchanger is to thermally couple fluid in the first conduit with fluid in the second conduit in use. In order to ensure these two conduits are effectively thermally engaged, the first conduit is preferably arranged inside the second conduit. Similarly, the chamber is preferably arranged inside the second conduit. A fluid inside the second conduit would then be in direct contact with the outside of the first conduit and the chamber.

The chamber preferably comprises a first end piece and a second end piece forming opposing sides of the chamber respectively, the first end piece coupled to the second end piece by a flow deflector, the flow deflector comprising a collar separating the first end piece from the second end piece, wherein the plate extends across the collar to form part of the flow deflector. These components may be fused together, as will be described. Typically, one or both of the first end piece and the second end piece comprises a first face arranged inside the chamber, a second face arranged outside the chamber and a foil member arranged between the first face and the second face, wherein the first face and the second face each comprise a sintered material applied to the foil member. The sintered material may be a metal powder such as silver, copper or titanium and is typically the metal as used in the foil member. The sintered body is porous and increases the effective surface area for adequate heat exchange between the fluid in the chamber and the fluid in the second conduit. However, sintered material is generally not compatible with high temperatures, such as can result from welding or fusing processes. A peripheral support member is therefore preferably arranged around the perimeter of each said foil member, the peripheral support member being fused to the collar, for example by a localised heating process such as laser or electron beam welding.

The first face and/or the second face may be profiled so that the thickness of the sinter on the foil member increases with the radial separation from the central axis. This is particularly advantageous wherein the heat exchanger comprises a central axis extending through the centre of the chamber, and wherein the first conduit is coupled to the chamber at two positions arranged along the central axis. Profiling the sinter in this way typically reduces the viscous heating within the heat exchanger. Typically both of the first and second end pieces are profiled in a similar manner. Any shape or profile that can be machined into a press tool can be used to apply the profiled sinter. For example, the sinter on the first and second end pieces may be profiled so that the separation between the first faces and the plate decreases, with the radial offset from the central axis, typically in a linear manner. Similarly, the sinter on the first and second end pieces may be profiled so that the separation between the second faces and the second conduit decreases, with the radial offset from the central axis, typically in a linear manner. The thickness of sinter applied to the foil members will typically range from 0.1-3.0 mm, preferably 0.2-2.0 mm thickness at any position along the first and second faces on which sinter is applied. For example, the sinter thickness may vary from a minimum of 0.5 mm near the centre of the foil member to 1 mm near the edge. The specific values may be chosen depending on the operational temperature for the heat exchanger. The maximum separation between the sinter on the first faces and the plate is typically from 0.1-5.0 mm, preferably 0.1-3.0 mm, preferably still 0.2-1.50 mm (as measured along the central axis of the chamber). This corresponds to the "depth of the chamber" or the "flow channel depth" inside the chamber.

The same material is typically used for forming the collar and the peripheral support member(s). For example, the collar and the peripheral support member(s) may each be formed of stainless steel. The sintered material and the foil member are preferably formed of the same material, for example silver, copper or titanium. The thermal conductivity of the foil member and/or the sintered material is preferably substantially higher than that of the peripheral support member and/or the collar. For example, thermal conductivity of the foil member and/or the sintered material may be at least twenty times larger than that of the peripheral support member and/or the collar when at a temperature of 300 K. The thermal conductivity of a material is generally dependent on its temperature however in this case the manufacturing processes are typically carried out at a notional 'room temperature'. At 300 K, the thermal conductivity of copper is around 392 W/m/K compared with around 15 W/m/K for stainless steel. The lower thermal conductivity of the peripheral support member(s) ensures that the heat input from fusing the end piece(s) to the collar is not effectively conducted to the sintered material so as to cause unwanted liquefaction of the sinter. The first end piece may be constructed similarly to the second end piece and fused to the collar to form the chamber to form a simple and effective heat exchanger suitable for low-temperature applications.

The chamber may define a flow channel for conveying the fluid through the first region and the second region. For example, the fluid may flow from an inlet of the chamber to an outlet of the chamber through an internal volume defined by a separation between the first face of the end pieces and the plate. Alternatively, the flow channel may be partially or fully formed within a sinter applied to the first end piece and the second end piece, and in particular within the sinter applied to the respective "first faces" of the end pieces (facing the plate). The flow channel may comprise one or more flow paths through the chamber, the one or more flow paths shaped by the sinter applied to the first end piece and the second end piece. The flow channel may therefore be imprinted onto the sintered material to define one or more pathways for the fluid to flow through the first region and the second region. The direction of flow of the operational fluid is thereby controlled, which can enable better heat dispersion through the chamber and improved thermal performance of the heat exchanger. One or more flow channels may also be imprinted to the sinter applied to the "second faces" of the end pieces forming part of the second conduit. This improves the thermal coupling across the heat exchanger. The depth of the flow channel(s) may decrease with the radial separation from the central axis in order to balance the impact of viscous heating against helium-3 requirement.

Further aspects of the invention will now be described that share similar advantages as discussed above. Any feature described in connection with one aspect is equally applicable to the remaining aspects.

Although the heat exchanger of the first aspect is particularly well suited to replacing prior art step heat exchanger using liquid helium, it may have applications in a variety of different cryogenic cooling systems. A second aspect of the invention provides a cryogenic cooling apparatus comprising: a target refrigerator; and a heat exchanger according to the first aspect, wherein the first conduit is arranged to convey an operational fluid to the target refrigerator and the second conduit arranged to convey the operational fluid from the target refrigerator. The operational fluid conveyed along the first conduit is typically in a different state from the operational fluid conveyed along the second conduit and typically also at a different temperature.

A third aspect of the invention provides a dilution refrigerator comprising: a still, a mixing chamber and a heat exchanger according to the first aspect, wherein the first conduit is arranged to flow an operational fluid from the still to the mixing chamber and the second conduit is arranged to flow the operational fluid from the mixing chamber to the still, the heat exchanger configured to thermally couple the operational fluid in the first conduit with the operational fluid in the second conduit.

The mixing chamber typically comprises a mass of sinter, and the first conduit comprises an end portion that is open and extends around a portion of the mass of sinter so as to bring said portion of the mass of sinter into contact with the operational fluid, the second conduit extending around the end portion and the mass of sinter so as to convey the operational fluid in a direction away from the mass of sinter. The dilution refrigerator is preferably configured such that operation of the dilution refrigerator causes a phase boundary to arise in the operational fluid at a position inside the end portion of the first conduit. This phase boundary refers to the boundary between the concentrated and dilute phases of helium-3 that typically arises within the mixing chamber of a dilution refrigerator. The incoming concentrated phase is typically conveyed by the first conduit from the position of the still to the mixing chamber such that it is in thermal contact with the outgoing dilute phase conveyed by the second conduit at the still and along the first conduit. It will be understood that the concentrated and dilute phases do not typically mix at the still.

The heat exchanger is typically simpler to construct than prior art step heat exchangers and so is well suited for low-temperature applications. A particular benefit is therefore achieved when the heat exchanger is arranged to obtain a temperature below 30 mK during operation of the dilution refrigerator. For example, the dilution refrigerator may further comprise a cold plate arranged between the still and the mixing chamber, the cold plate arranged to obtain a base temperature between that of the still and the mixing during operation of the dilution refrigerator, the dilution refrigerator further comprising a chamber assembly comprising one or more said chambers arranged along a portion of the first conduit extending between the cold plate and the mixing chamber, each said chamber being arranged to receive the operational fluid from the first conduit, and wherein second conduit is thermally coupled to the outside of each said chamber.

In steady state operation, the total fluid flow rate through all the chambers will be equal. The temperature of the fluid from the first conduit will typically lower as it progresses further through the chamber assembly into the lower temperature region. In many cases, the viscosity of a fluid may increase as the temperature is reduced and the flow of a viscous fluid can lead to unwanted heating, reducing the efficiency of the heat exchanger. To mitigate against this, so called 'flow channels' can be introduced to provide a low-impedance path through which the fluid can flow. The size of these flow channels is generally controlled to provide the required fluid flow rates whilst reducing the total amount of fluid in the chamber (thereby lowering the amount of helium-3 required for operation, which is a scarce and expensive resource). Many existing dilution refrigerators are reliant on custom-built, unique sized or shaped parts however volume manufacture and automation favours part commonality. Preferably, therefore, each said chamber comprises one or more flow channels for conveying the fluid through the respective first region and the respective second region, wherein each said flow channel is formed within a sinter, wherein the chamber assembly is arranged along a thermal gradient during operation of the dilution refrigerator so that a first said chamber is arranged to obtain a higher base temperature than a second said chamber, and wherein the diameter of the one or more flow channels in the first chamber is lower than the diameter of the one or more flow channels in the second chamber. The diameter of any flow channels may thereby be controlled to achieve a desired balance between flow rates and total fluid volume. This improves the thermal performance of the heat exchanger. The second conduit may also comprise flow channels that are formed within a sinter on the outside of the chamber to further improve the thermal performance of the heat exchanger. Imprinting the flow channels into the sinter also allows the flow channels to be mass produced in an efficient and repeatable manner.

The chamber assembly may form a step heat exchanger, with each heat exchanger corresponding to a respective step and configured to obtain a respective temperature during operation of the dilution refrigerator. The chamber assembly may comprise a first said heat exchanger and a second said heat exchanger, the first said heat exchanger being arranged between the cold plate and the second heat exchanger chamber, wherein the depth of the chamber for the second said heat exchanger and/or the number/size of apertures through the plate of the second said heat exchanger is higher than that of the first said heat exchanger. This optimises the flow of the fluid through the chamber assembly to improve performance of the system, as previously described.

In order to further simplify the method of assembly, the chamber assembly and the mixing chamber are preferably rotationally symmetric about an axis extending through the first conduit. Furthermore, the second conduit preferably forms the exterior of the heat exchanger and comprises a plurality of modules that are fused together. Similarly, the first conduit is preferably formed from a plurality of modules that are fused together. This fusing process can be formed by electron-beam welding or laser beam welding and produces reliable joints without the need for intricate and time-consuming manual processes.

A fourth aspect of the invention is a method of forming a heat exchanger for a cryogenic refrigerator, the method comprising: providing a first conduit, a second conduit, a first end piece, a second end piece and a flow deflector, the flow deflector comprising a collar and a plate, the plate extending across the collar; wherein providing the first end piece comprises: fusing a first peripheral support member around the perimeter of a first foil member, and then applying a sintered material to opposing faces of the first foil member, the thermal conductivity of the first peripheral support member being at least twenty times lower than that of the first foil member when at a temperature of 300 K; fusing the first peripheral support member to the collar so as to form a chamber, the chamber having a first region separated from a second region by the plate, the plate arranged between the first end piece and the second end piece; wherein the first conduit is arranged to convey a fluid into the first region and out from the second region, and wherein the plate comprises one or more apertures for allowing a flow of the fluid from the first region to the second region; and wherein second conduit is thermally coupled to the outside of the chamber.

The method is practically easier to perform than the intricate jointing processes typically required for assembling prior art step heat exchangers. The method is also more amenable for automation. Consequently, the heat exchanger takes less time to assemble and the standard deviation in the performance of different heat exchangers produced according to the same technique is reduced. Sintered material (typically formed from a metal powder such as silver or copper) is applied to the foil member for increasing the surface area for heat exchange between the fluid in the chamber and any fluid in the second conduit in use. The sintered material is liable to melt if exposed to high temperatures. The peripheral support member is therefore fused to the foil member prior to applying the sintered material. Furthermore, the peripheral support member is selected to have a lower thermal conductivity than the sintered material and preferably also the foil member. Once the sintered material is applied, the peripheral support member can then be fused to the collar to form the chamber without risk of melting the sintered material.

A first portion of the first conduit is preferably fused to the first foil member so as to facilitate a flow of the fluid through the first foil member. This typically occurs prior to applying the sintered material and may occur at the same time as when the first peripheral support member is fused to the first foil member. The first portion of the first conduit, and preferably also the first peripheral support member, are preferably fused to the first foil member by welding or vacuum brazing. For example, the parts may be assembled together and then baked in a vacuum chamber to fuse. A similar process may then be followed for forming the second end piece. For example, providing the second end piece may comprise: fusing a second peripheral support member around the perimeter of a second foil member, and then applying a sintered material to opposing faces of the second foil member, the thermal conductivity of the second peripheral support member being at least twenty times lower than that of the second foil member when at a temperature of 300 K, wherein forming the chamber further comprises fusing the second peripheral support member to the collar. The method may further comprise: fusing a second portion of the first conduit to the second foil member so as to facilitate a flow of the fluid through the second foil member, wherein the second portion of the first conduit is preferably fused to the second foil member by welding or vacuum brazing. Typically, the second portion of the first conduit is fused to the second foil member before the sintered material is applied to the second foil member and preferably at the same time as the second peripheral support member is fused to the second foil member. The second portion of the first conduit, and preferably also the second peripheral support member, are preferably fused to the second foil member by welding or vacuum brazing. The second peripheral support member is preferably fused to the collar at the same time as the first peripheral support member. Each said peripheral support member is preferably fused to the respective foil member by vacuum brazing. In contrast, each said support member is preferably fused to the collar by a localised heat source, such as laser or electron beam welding. A localised heating process is preferable because the sintered material has already been applied to the foil member at this stage and so it is desirable to reduce the amount of heat conducted to the sinter.

A fifth aspect of the invention is a method of forming a dilution refrigerator, comprising: providing a still and a mixing chamber, and forming a heat exchanger according to any of the preceding aspects, wherein the first conduit is arranged to flow an operational fluid from the still to the mixing chamber, and wherein the second conduit is arranged to flow the operational fluid from the mixing chamber to the still.

The first conduit preferably comprises an end portion arranged to receive the operational fluid from the chamber, and providing the mixing chamber then comprises: arranging the end portion around a portion of a mass of sinter so as to bring said portion of the mass of sinter into contact with the operational fluid, and arranging the second conduit around the end portion and the mass of sinter so as to convey the operational fluid in a direction away from the mass of sinter. The mass of sinter may be formed of a sintered material or from several smaller sintered masses, and is shaped to be received by the end portion of the first conduit. The method may then further comprise sealing the second conduit to a support on which the sintered mass is mounted. This closes a distal end of the second conduit on the support, which may be the lowest-temperature thermal stage for the dilution refrigerator.

A particular benefit may be achieved when the first conduit and the second conduit are formed from a plurality of modules for assembly, the method further comprising fusing a first module of the first conduit together with a second module of the first conduit at a position between the chamber and the end portion, and/or fusing a first module of the second conduit together with a second module of the second conduit at a position between the chamber and the end portion. The resulting assembly has a fully welded construction, which ensures that the joints are reliably formed according to a fast and highly repeatable process.

The heat exchange of the first aspect is particularly well suited for use in low temperatures, including those below 30 millikelvin. The cold plate of a dilution refrigerator typically has an base temperature from 40 to 150 millikelvin, more preferably from 40 to 60 millikelvin, whereas the mixing chamber typically has a base temperature that is less than 25 millikelvin, and preferably less than 10 millikelvin in use. The method may therefore further comprise: arranging a cold plate between the still and the mixing chamber so as to obtain a base temperature between that of the still and the mixing during operation of the dilution refrigerator; providing a plurality of said chambers arranged along a portion of the first conduit extending between the cold plate and the mixing chamber, each said chamber arranged to receive the operational fluid from the first conduit, and wherein second conduit is thermally coupled to the outside of each said chamber. As before, the first conduit and the second conduit are preferably formed from a plurality of modules for assembly, the method further comprising fusing a first module of the first conduit together with a second module of the first conduit at a position between two said chambers, and/or fusing a first module of the second conduit together with a second module of the second conduit at a position between two said chambers. These chambers will typically be similarly formed and comprise the features discussed in connection with the first aspect. The modules are preferably fused together using a localised heat source, and preferably by electron beam welding, which reduces the heat input to the sinters. Furthermore, in order to ensure effective heat transfer between the operational fluid in the first conduit and the second conduit, a portion of the first conduit extending from the cold plate to the mixing chamber is preferably arranged inside the second conduit. The chambers are also preferably arranged substantially inside the second conduit.

A sixth aspect of the invention is a dilution refrigerator comprising: a still and a mixing chamber; a first conduit arranged to convey an operational fluid from the still to the mixing chamber; a second conduit arranged to convey the operational fluid from the mixing chamber to the still; a heat exchanger arranged to thermally couple the operational fluid in the first conduit with the operational fluid in the second conduit at a position between the still and the mixing chamber; characterised in that the heat exchanger comprises one or more chambers arranged along a portion of the first conduit, each said chamber having a first region and a second region, the first region separated from the second region by a plate extending through the chamber, the plate comprising one or more apertures for allowing a flow of the operational fluid from the first region to the second region, and wherein second conduit is arranged around the outside of each said chamber.

A plurality of chambers is preferably provided, the second conduit being formed of a plurality of modules that are welded together between each said chamber, and the first conduit is preferably formed of a plurality of modules that are welded together between each said chamber. Each said chamber preferably comprises a first end piece and a second end piece forming opposing sides of the chamber respectively, the first end piece coupled to the second end piece by a flow deflector, the flow deflector comprising a collar separating the first end piece from the second end piece, wherein the plate extends across the collar, wherein each of the first end piece and the second end piece has a first face arranged inside the chamber and a second face arranged outside the chamber, the first face and the second face being formed from a sintered material applied to a foil member arranged between the first face and the second face, wherein each of the first and second end pieces further comprise a respective outer support member extending around the perimeter of the respective foil member, the outer support member fused to the collar. The thermal conductivity of the foil members is typically at least twenty times larger than that of the outer support members when at a temperature of 300 K.

BRIEF DESCRIPTION OF THE DRAWINGS

Embodiments of the invention will now be discussed with reference to the accompanying drawings in which.

DETAILED DESCRIPTION

Figure 1:
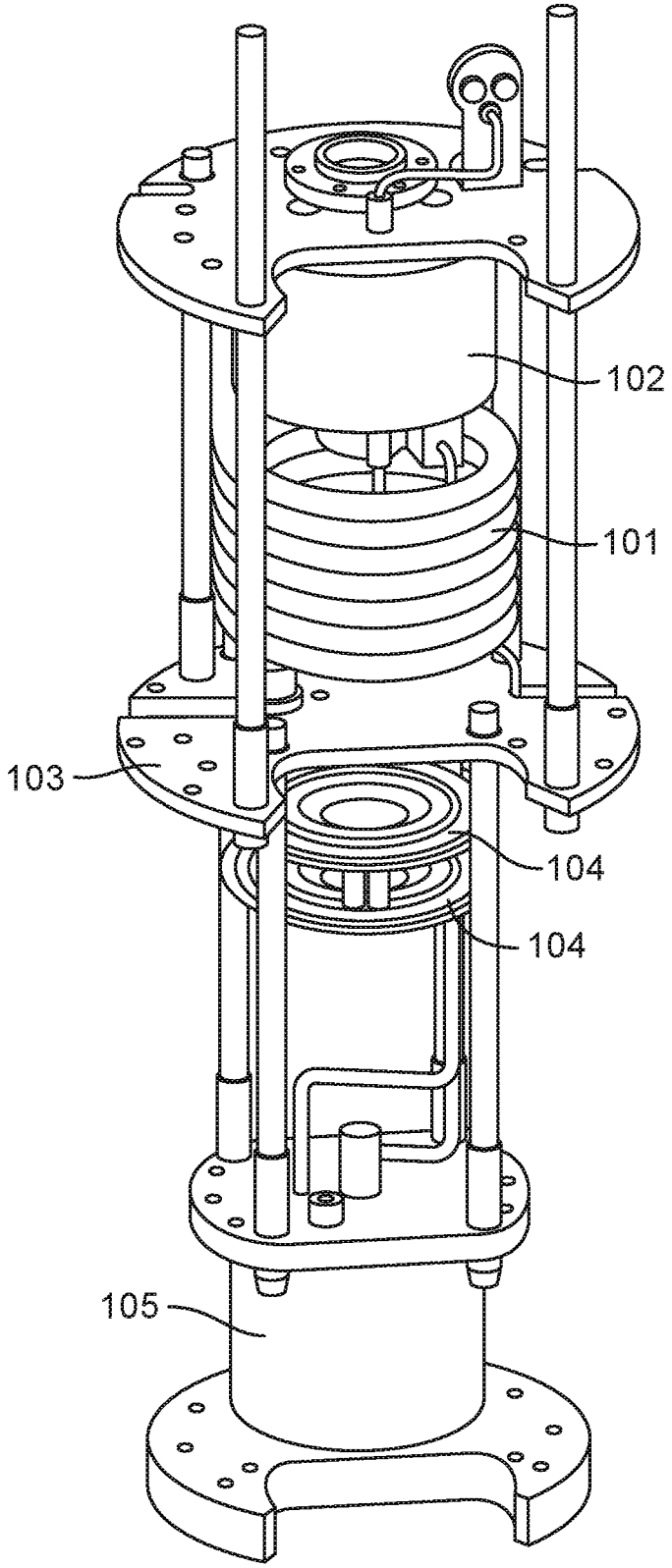
Fig. 1 Prior Art
FIG. 1 is an illustration of a prior art dilution unit.
Figure 2:
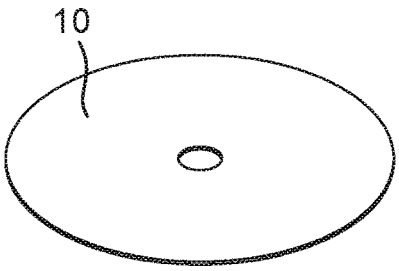
FIG. 2 is an illustration of a perspective view of a foil member forming part of a first embodiment of the invention.
Figure 3:
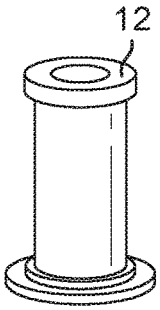
FIG. 3 is an illustration of a perspective view of a first portion of a first conduit forming part of the first embodiment of the invention.
Figure 4:
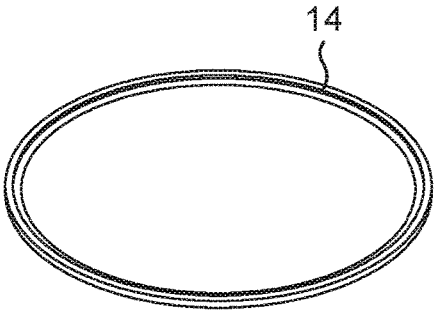
FIG. 4 is an illustration of a perspective view of a peripheral support member forming part of the first embodiment of the invention.
Figure 5:
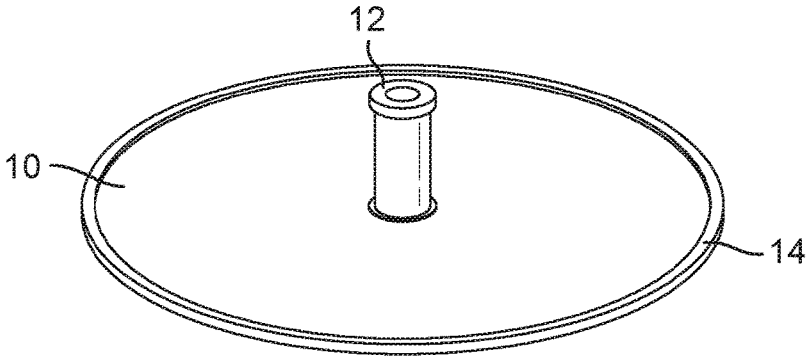
FIG. 5 is an illustration of a perspective view of a first end piece forming part of the first embodiment of the invention prior to applying a sintered material.

A method for assembling a heat exchanger and a dilution refrigerator according to a first embodiment of the invention will now be discussed. The method begins at step 201 (FIG. 12), at which point first and second end pieces are produced for forming part of a heat exchanger. A first foil member 10 (FIG. 2) is provided that is formed from a high thermal conductivity material such as silver or copper, typically with a thermal conductivity greater than 300 W/m/K at 300 K. In this case, the first foil member 10 is a substantially planar silver disc having a central aperture for receiving an inlet tube 12 forming a first portion of a first conduit (to be discussed) that conveys an operational fluid in use. The first foil member 10 has diameter of around 45 mm but more generally is usually between 20-100 mm depending on the application. A first peripheral support member 14 (FIG. 4) is provided, formed from a relatively low thermal conductivity material such as stainless steel, typically with a thermal conductivity below 15 W/m/K at 300 K. The first peripheral support member 14 is ring-shaped and configured to support the first foil member 10. The first peripheral support member 14 extends around the outside of the first foil member 10, contacting the perimeter of the first foil member 10 and an outer portion of one of the opposing faces of the first foil member 10. The first foil member 10, inlet tube 12 and peripheral support member are assembled, as shown in FIG. 5, and then fused together, for example by welding or vacuum brazing.

A material to be sintered is next applied as a powder to the major faces of the first foil member 10. The sinter material is a high thermal conductivity material and typically the same material as used as the first foil member 10. Pressure is applied to form a sinter 15 on the two opposing faces of the first foil member 10. In the case of a silver powder pressure alone is sufficient for this operation, however copper powders typically also need to be baked during this operation. With the appropriate tooling, the powder can be pressed onto both sides of the first foil member 10 in one operation. The sinter 15 is typically applied to the entire surface of the two major faces of the first foil member 10 but not to the peripheral support member 14. A first end piece 22 for a heat exchanger is thereby produced. This process is then repeated with a second foil member 11, second peripheral support member and an outlet tube 32 to form a second end piece 24.

Figure 6:
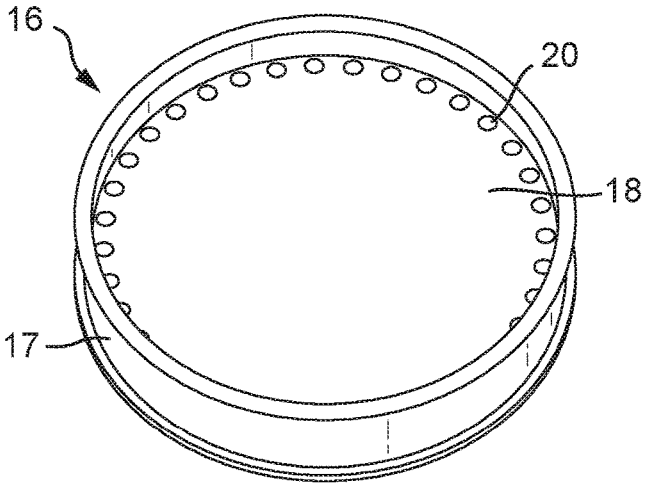
FIG. 6 is an illustration of a perspective view of a flow deflector forming part of the first embodiment of the invention.

The first end piece 22 and the second end piece 24 are configured to fit against opposing ends of a flow deflector 16, which is shown by FIG. 6. The flow deflector 16 comprises a collar 17, which is an annular element having approximately the same circumference as the peripheral support members. A plate 18 extends across the flow deflector 16 in a radial direction. The plate 18 is arranged approximately centrally within the collar 17, subdividing the flow deflector 16 into an upper portion and a lower portion that are provided on opposite sides of the plate 18, inside the collar 17. The plate 18 comprises a plurality of apertures 20 to fluidly couple the upper and lower portions. In FIG. 6 these apertures are dispersed at a constant radius around the plate 18, with approximately a constant separation kept between each neighbouring aperture. In the present embodiment the flow deflector 16 is formed as a unitary member. In particular, the flow deflector 16 is a "machined body" and the apertures may be added by a process such as electrical discharge machining. Alternatively, the flow deflector 16 can be formed from a foil element with apertures formed in the foil element, for example by etching. This foil element would then be welded between two annular supports to form the flow deflector 16.

Figure 7:
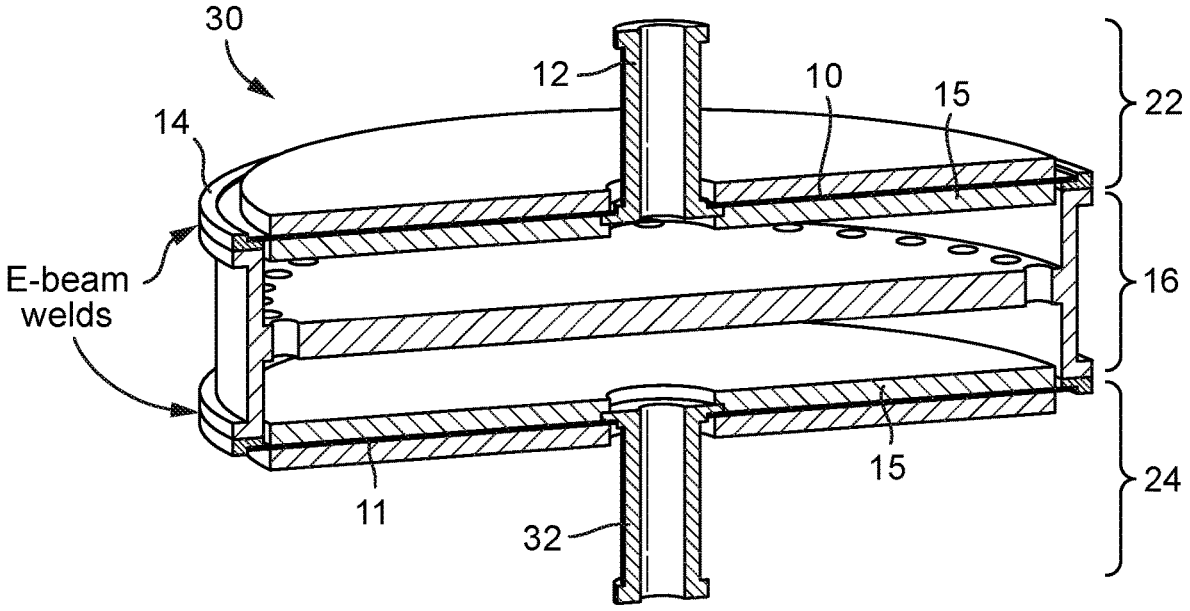
FIG. 7 is a first cross-sectional illustration of a chamber forming part of the first embodiment of the invention.

The method proceeds to step 202, at which point the heat exchanger chamber 30 is formed. The first and second end pieces 22, 24 are arranged against opposing ends of the flow deflector 16, as shown in FIG. 7, with the sinter material 15 applied to the distal face of each end piece arranged inside the collar 17, and the peripheral support members contacting opposing ends of the collar 17. A highly controlled, localised heating process, such as electron-beam welding, laser beam welding or Tungsten Inert Gas (TIG) welding, is then used to fuse the peripheral support members to the respective ends of the collar 17 and thereby form a chamber 30. The localised heating process used to fuse the first and second end pieces 22, 24 to the collar 17, combined with the relatively low thermal conductivity of the stainless steel peripheral support members, protects the sinter 15 from the heat of the welding process. The location of the electron-beam welds for the present embodiment are indicated in FIG. 7, however it will be appreciated that the weld is typically made around the circumference of the peripheral support members. It is advantageous therefore that the inlet tube 12 and the outlet tube 32 extend along the central axis for the flow defector 16 and the chamber 30 because the assembly can then be rotated about the inlet tube 12 and the outlet tube 32 when performing the welding procedure, without needing to move the heating element. This process is amenable to automation and ensures that a reliable joint is welded.

The chamber 30 formed has a first region 26 separated from a second region 28 by the plate 18, with the inlet tube 12 arranged to flow a fluid into the first region, and the outlet tube 32 arranged to flow a fluid out of the second region. The inlet tube 12 and the outlet tube 32 form first and second portions of a first conduit 46 respectively, the first conduit 46 being arranged to flow a fluid through the chamber 30. When used within a dilution refrigerator the first conduit 46 and the chamber 30 will accommodate the flow of helium-3 rich phase of operational fluid during steady state operation from a still (including from the outside of the still) to a mixing chamber 45 of the dilution refrigerator. The first conduit 46 is also commonly referred to as the 'concentrated phase flow channel' in a dilution refrigerator. Arrows are included to FIG. 8 (which is not to scale) to indicate the direction of flow of the fluid through the inside of the chamber 30. As shown, the arrangement of the apertures 20, which are radially dispersed from the central axis along which the inlet and outlet tubes 12, 32 are arranged, ensures that the fluid follows a non-linear flow path inside the chamber 30. This, combined with the use of the sintered material 15 on the first and second end pieces 22, 24, ensures that a large effective surface area is provided for heat exchange between a fluid inside the chamber 30 and another fluid in contact with the outside of the chamber 30. The origin and flow of this surrounding fluid will be now discussed with reference to steps 203 and 204 from FIG. 12.

Figure 9:
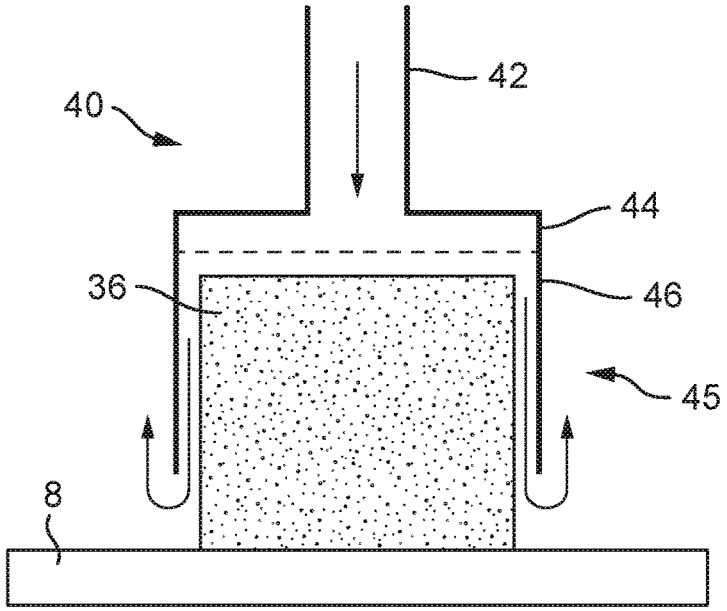
FIG. 9 is a first cross-sectional illustration of a mixing chamber forming part of the first embodiment of the invention.

The method proceeds to step 203, at which point a mixing chamber 45 for the dilution refrigerator is formed. A mass of sinter 36 is formed directly onto, or mounted to a high thermal conductivity support 8, which forms the lowest temperature stage of the dilution refrigerator. The material forming the mass of sinter 36 is typically the same material as was applied to the first and second foil members 10, 11 (e.g. silver and/or copper). An end portion 40 of the first conduit 46 is provided, the end portion 40 having a first region 42 and a second region 44, the second region 44 having a larger diameter than the first region 42. The end portion 40 is arranged so that the first region 42 is configured to receive a flow of the fluid from the outlet tube 32 and the second region 44 is arranged so that a proximal portion of the mass of sinter is arranged inside the second region 44 and a distal portion of the mass of sinter is outside the end portion 40. The end portion 40 is thus arranged relative to the mass of sinter 36 so that a phase boundary of the operational fluid between a helium-3 rich phase and a helium-3 poor phase exists inside the end portion 40 and preferably inside the second region 44, as shown by the broken line in FIG. 9. Arrows are provided in FIG. 9 to show the direction of flow of the fluid from along the first region 42 of the end portion 40 and around the mass of sinter 36 into a region surrounding the mixing chamber 45. Of course, this direction of flow is only possible when the dilution refrigerator is fully assembled and operational. In use, the concentrated steam is typically contained inside the end portion 40 and so the end portion 40 may also be referred to as a 'concentrated steam cap'.

Figure 10:
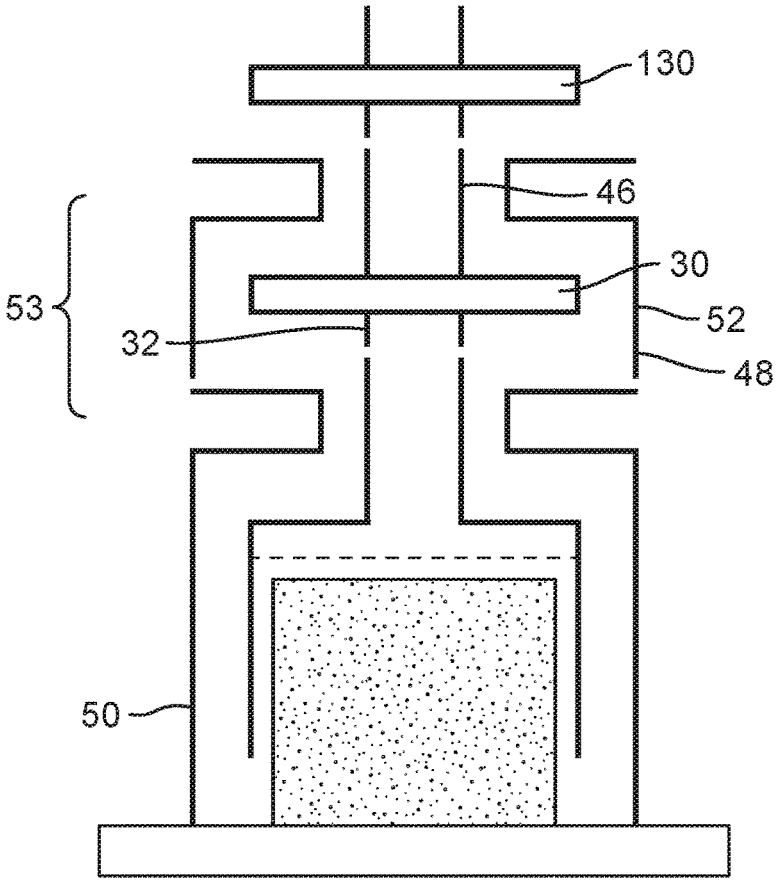
FIG. 10 is a second cross-sectional illustration of a mixing chamber forming part of the first embodiment of the invention.

FIG. 10 shows a second conduit 48 formed surrounding the first conduit 46. The second conduit 48 is also referred to as the 'dilute phase flow channel' that is arranged to return the fluid from the mixing chamber 45 to the still. The second conduit 48 is co-axially arranged around the outside of the first conduit 46. The first conduit 46 and the second conduit 48 are each formed from a series of modules that are welded together at step 204 to form the heat exchanger assembly. With the end portion 40 arranged over the mass of sinter 36 (as discussed with reference to FIG. 9), a first portion 50 of the second conduit 48 is arranged over and around the end portion 40 and mounted to the support 8. Typically, the first portion 50 of the second conduit 48 is sealed to the support 8 by an indium seal, alternatively though a ConFlat (CF) flange may be used to achieve this mounting. The first portion 50 of the second conduit 48 is thereby arranged to receive a flow of operational fluid from the end of the first conduit 46.

A distal end of the outlet tube 32 is then welded to a proximal end of the first region 42 of the end portion 40. This fluidly couples the inlet tube 12 with the mixing chamber 45 and the second conduit 48. A distal end of a second portion 52 of the second conduit 48 is then fused to a proximal end of the first portion 50 of the second conduit 48. This joint is made around the central axis of the assembly and at a position between the chamber 30 and the mass of sinter 36, typically along the first region 42 of the end portion 40 of the first conduit 46. FIGS. 7-10 are schematic illustrations and thus not to scale, however, an approximate constant separation is maintained between the inner walls of the second conduit 48 and the outer walls of the first conduit 46. The second conduit 48 conforms around the shape of the chamber 30 to form a step in a step heat exchanger 53. In normal operation of a dilution refrigerator helium-3 is evaporated from the still and removed by a pumping system. This drives a flow of helium-3 atoms to cross the phase boundary at the mixing chamber 45 (from the concentrated to dilute phases) to replenish the helium-3 in the still. The dilution of helium-3 into the dilute phase causes cooling at the mixing chamber 45. The dilute phase of helium that flows along the second conduit 48 will therefore be cooler than the incoming concentrated phase of helium-3 conveyed along the first conduit 46. The relatively large surface area of the chamber 30 forms an effective heat exchanger so that the fluid in the first conduit 34 and chamber 30 is further cooled prior to arriving at the mixing chamber 45.

The heat exchanger assembly may comprise a plurality of step heat exchangers 53 or "steps", each step formed of a chamber (as described with reference to FIGS. 7 and 8) arranged along the first conduit 46, and being surrounded by a portion of the second conduit 48. FIG. 10 shows a second such chamber 130 together with corresponding portions of the first conduit 46 arranged above the proximal end of the inlet tube 12. The respective portions of the first and second conduits would be fused together about the central axis, as discussed above, in a step-wise manner to form the completed assembly.

Figure 11:
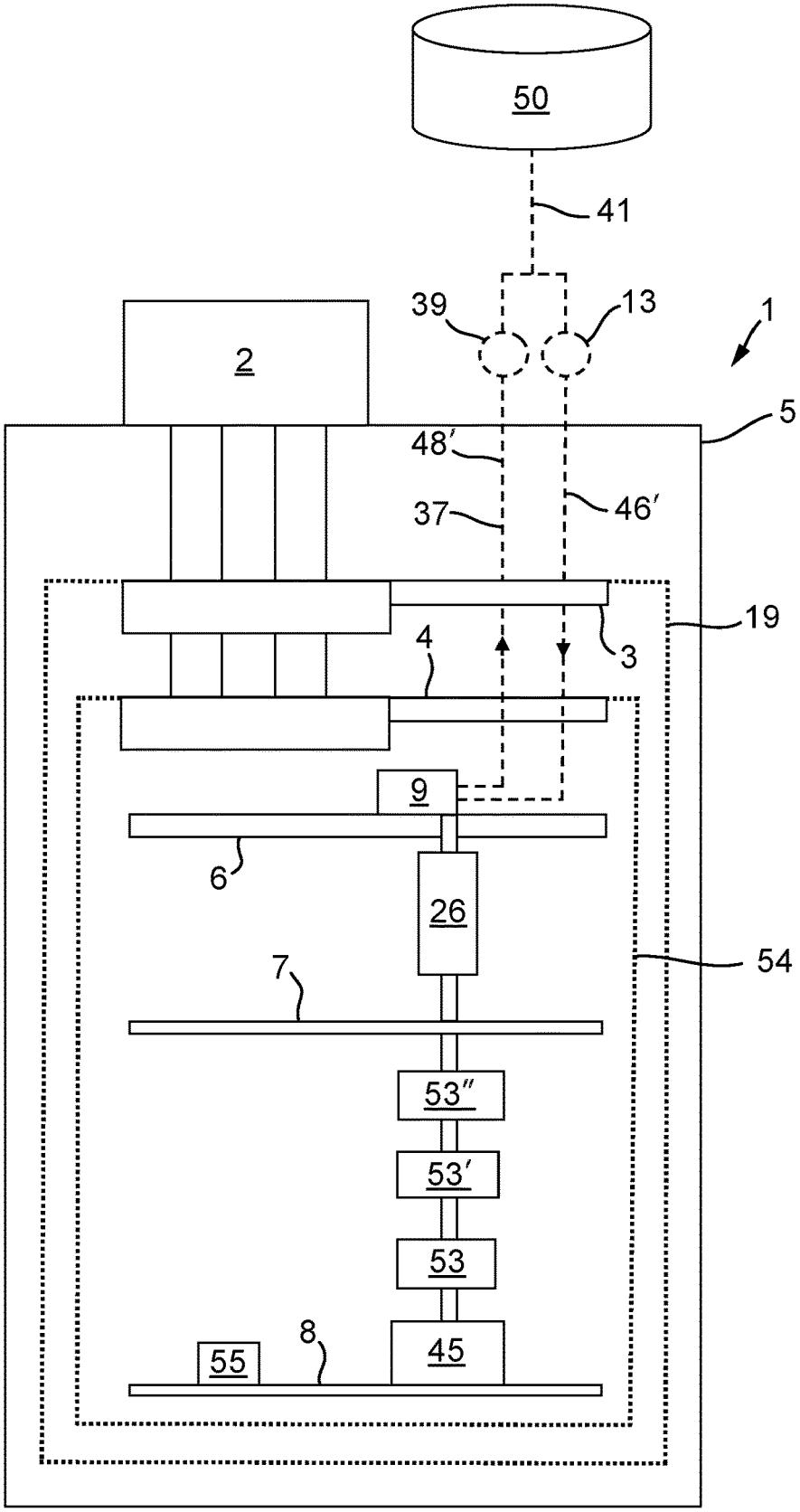
FIG. 11 is a schematic illustration of a dilution refrigerator according to the first embodiment.

The arrangement of the heat exchanger assembly within a dilution refrigerator is shown by the schematic illustration in FIG. 11, which will now be discussed. A cryostat 1 is provided comprising a large hollow cylinder, typically formed from stainless steel or aluminium, which comprises an outer vacuum vessel 5. A plurality of spatially dispersed stages is provided within the cryostat 1, comprising a first stage 6, a second stage 7 and a third stage 8. Each stage provides a platform formed from high conductivity material (e.g. copper) and is spaced apart from the remaining stages by low thermal conductivity rods (not shown). The second stage 7 is commonly referred to as the "cold plate" and provides an intermediary heat sink between the first stage 6 and the third stage 8. A sample holder 55 is shown mounted to the third stage 8, which forms the lowest temperature stage during steady state operation of the system.

The cryostat 1 in the present example is substantially cryogen-free (also referred to in the art as "dry") in that it is not principally cooled by contact with a reservoir of cryogenic fluid. The cooling of the cryostat is instead achieved by use of a mechanical refrigerator, which may be a Stirling refrigerator, a Gifford-McMahon (GM) refrigerator, or a pulse-tube refrigerator (PTR). However, despite being substantially cryogen free, some cryogenic fluid is typically present within the cryostat when in use to facilitate normal operation of the dilution unit. The main cooling power of cryostat 1 is provided in this embodiment by a PTR 2. PTRs generate cooling by controlling the compression and expansion of a working fluid which is supplied at high pressure from an external compressor. The first PTR stage will typically have a relatively high cooling power in comparison with the second PTR stage. In the present case, the PTR 2 cools a first PTR stage 3 to about 50 to 70 kelvin and a second PTR stage 4 to about 3 to 5 kelvin. The second PTR stage 4 therefore forms the lowest temperature stage of the PTR 2.

Various heat radiation shields are provided inside the outer vacuum vessel 5, wherein each shield encloses each of the remaining lower base-temperature components. The first PTR stage 3 is thermally coupled to a first radiation shield 19 and the second PTR stage 4 is thermally coupled to a second radiation shield 54. The first radiation shield 19 surrounds the second radiation shield 54 and the second radiation shield 54 surrounds each of the first, second and third stages 6-8. Additionally, the first and second stages 6 and 7 could in theory be connected to respective heat radiation shields, in order to reduce any unwanted thermal communication between the stages.

The still 9 of the dilution refrigerator is operable to cool the first stage 6 to a base temperature of 0.5-2 kelvin. The mixing chamber 45 is mounted to the third stage 8 and is operable to cool the third stage 8 to a base temperature below 10 millikelvin. In use, the second stage 7 obtains a base temperature between that of the first stage 6 and the third stage 8, typically of 40-150 millikelvin.

The still 9 is fluidly coupled to a storage vessel 50 by a cooling circuit 37. The storage vessel 50 is arranged outside the cryostat 1 and contains an operational fluid in the form of a mixture of helium-3 and helium-4 isotopes. Various pumps 17, 39 are also arranged outside the cryostat 1, along conduits of the cooling circuit 37 for controlling a flow of the operational fluids around the circuit, as indicated by the solid arrowheads. The cooling circuit 37 comprises a supply line 41 which provides a conduit to facilitate a flow of operational fluid from the storage vessel 50 to a condensing line 46'. This fluid may then be conveyed along the condensing line 46' to the still 9 whereupon it is in thermal contact with the dilute phase of helium inside the still 9. The condensing line 46' then continues into a concentrated phase flow channel 46 from the still 9 to the mixing chamber 45. The condensing line 46' and the concentrated phase flow channel 46 further comprise one or more impedances (not shown) for reducing the temperature of the operational fluid due to the Joule-Thomson effect as it flows towards the mixing chamber 45. A compressor pump 13 is arranged along the condensing line 46' for providing this flow at a pressure of 0.5-2 bar. A dilute phase flow channel 48 is arranged to convey the operational fluid from the mixing chamber 45 through the still 9, whereupon this fluid is conveyed to a position exterior to the cryostat 1 by a still pumping line 48'. The operational fluid may then be circulated from this position back into the condensing line 46'. A turbomolecular pump 39 is arranged along the still pumping line 48' for providing a high vacuum on the low pressure side of the circuit (for example less than 0.1 mbar), and so enables the flow of the operational fluid away from the still 9.

The concentrated phase flow channel 46 and dilute phase flow channel 48 form the first and second conduits respectively of the heat exchanger, as earlier discussed. These conduits are not explicitly shown between the first stage 6 and the third stage 8 in the schematic illustration of FIG. 11 for sake of clarity. The first and second conduits 46, 48 are arranged to form a continuous heat exchanger 26 positioned between the first stage 6 and the second stage or 'cold plate' 7. Within the continuous heat exchanger 26, the first conduit 46 is arranged in a coil and the second conduit 48 is wrapped around the first conduit 46. This ensures that the helium-3 concentrated phase of fluid flowing along the first conduit 46 is cooled by the helium-3 dilute phase of fluid flowing along the second conduit 48. Continuous heat exchangers are only are only typically effective at temperatures above 30 millikelvin. Therefore a step heat exchanger assembly comprising a plurality of step heat exchangers 53, 53', 53" (as earlier discussed with reference to FIGS. 2-10) is arranged at the lower temperature region between the second stage 7 and the third stage 8. The fluid in the first conduit 46 flows from the second stage 7 to the mixing chamber 45 via a plurality of chambers comprising flow deflectors. The helium-3 dilute phase of fluid flows from the mixing chamber 45 back along the second conduit that encloses the chambers. The outgoing fluid in the second conduit is directly in contact with the outer walls of the first conduit and the chambers to further cool the incoming fluid in the first conduit.

The viscosity of a fluid may increase as the temperature is reduced and the flow of a viscous fluid can lead to unwanted heating, reducing the efficiency of the heat exchanger. To mitigate against this, the depth of the chambers and/or the number or size of apertures inside the chamber may increase for chambers that are arranged at lower temperatures. For example, the depth of the chamber (along the central axis of the assembly) may be smallest for the uppermost step heat exchanger (to reduce the total volume of helium-3 required for operation) and largest for the lowermost step heat exchanger (to reduce viscous heating).

It has been found that this increases thermal performance of the system by optimising the balance between viscous heating and total fluid volume.

Figure 8:
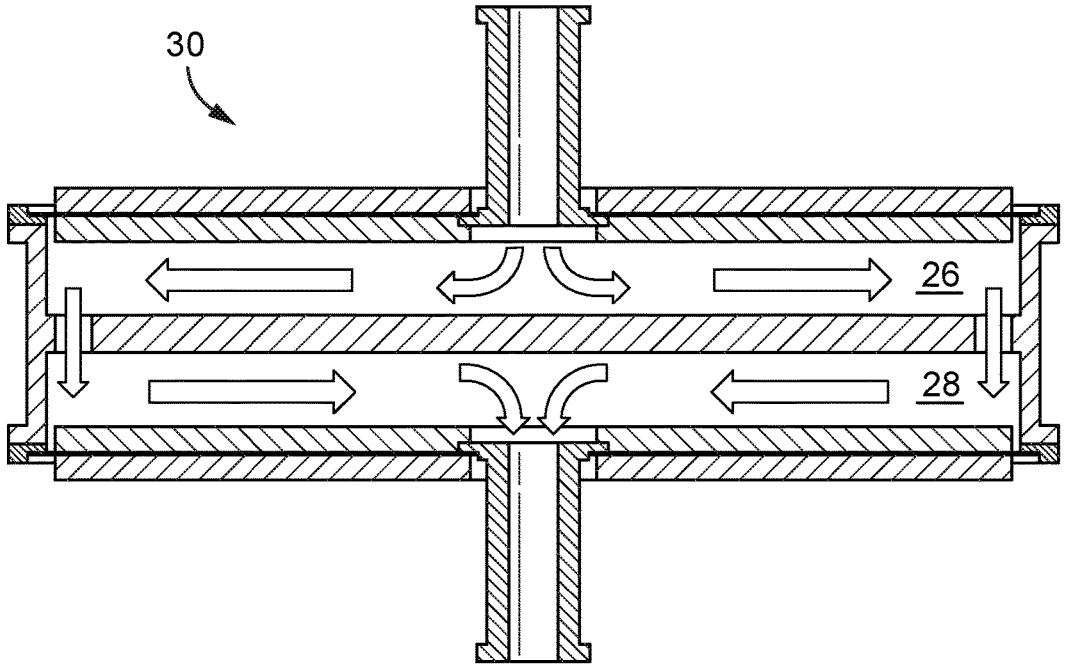
FIG. 8 is a second cross-sectional illustration of a chamber forming part of the first embodiment of the invention.

The height of the first region 26 and the second region 28 is depicted as being relatively large in FIGS. 7 and 8 for ease of explanation but, in particular where used within a dilution refrigerator, is preferably of the order of 0.1-5.0 mm, preferably still 0.2-1.5 mm. This height may vary depending on the operating temperature of the heat exchanger, as determined by its position along the first conduit 46 (as described above). In general the shape and dimensions of the first region 26 and second region 28 are selected to promote circulation of the helium-3, reduce viscous heating, allow for an osmotic pressure to develop in the still 9 and mixing chamber 45, reduce the amount of helium-3 used and reduce hydrodynamic instabilities and convection. Similar considerations apply for the surrounding second conduit 48.

Figure 13:
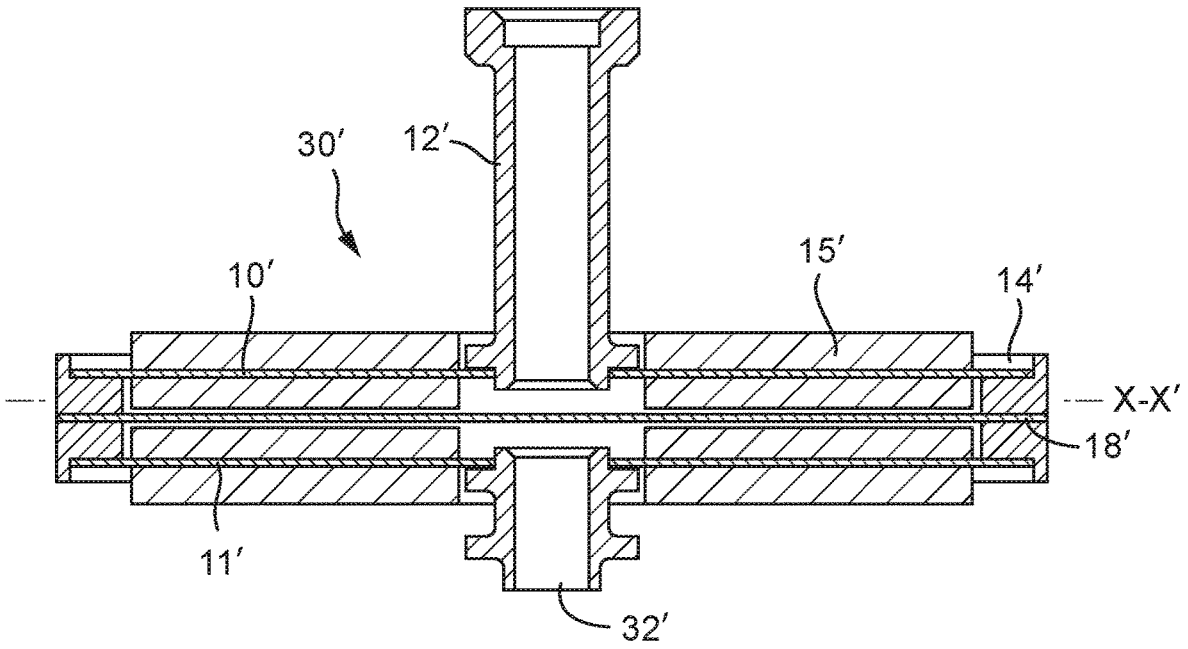
FIG. 13 is a cross-sectional illustration of a chamber forming part of a second embodiment of the invention.
Figure 14:
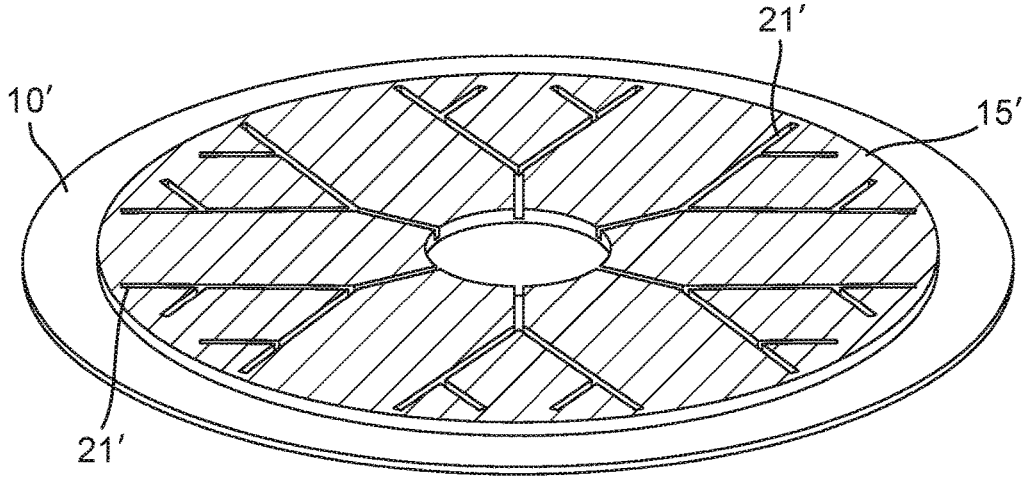
FIG. 14 is an illustration of a foil member forming part of the second embodiment.

FIGS. 13 and 14 illustrate parts of a heat exchanger according to a second embodiment of the invention. FIG. 13 is a cross-sectional illustration equivalent of that of FIG. 7 in which primed reference numerals have been used to show like features. In this embodiment the plate 18' for the flow deflector is a foil element welded between two annular supports. The chamber 30' is otherwise formed essentially as described in the first embodiment with reference to FIGS. 2-8 but in this case dedicated flow channels 21' are formed within the sinter 15' for conveying the helium-3 concentrated phase of fluid from the inlet tube 12' through the apertures and returning it to the outlet tube 32' (where it is understood that similar features could also be applied to the sinters 15' on the opposite sides of the foil members 10', 11' for conveying the dilute phase fluid). Sinter 15' is applied to both faces of the first and second foil members 10', 11', however the first and second foil members 10', 11' are arranged within the chamber 30' so that the sinter 15' applied to a first face of the first foil member 10' and a first face of the second foil member 11' is separated from the opposing faces of the flow deflector plate 18' by a small gap, typically of 0.1-1.0 mm, preferably 0.2-0.6 mm (depending on the configuration). Optionally opposite sides of the flow deflector plate 18' instead abut against the sinter 15' on the first face of the first and second foil members 10', 11' to leave no such separation. The flow channels 21' are typically imprinted into the sinter during step 201 and can take a variety of different patterns for controlling the direction of flow of the operational fluid. One or more channels may be provided inside the chamber 30' for conveying the concentrated phase of fluid through the first region to the apertures of the plate 18' and then through the second region of the chamber 30' to the outlet tube 32'. One or more channels may further be provided for conveying the dilute phase of fluid through the second conduit on the outside of the chamber 30'. Any number of different patterns could be applied including radial or spiralling. FIG. 14 is a perspective view of the sinter 15' taken through the plane X-X' from FIG. 13. In FIG. 14 the flow channels 21' bifurcate to bring a greater portion of the sinter 15' into close contact with the operational fluid and so enhance the performance of the heat exchanger.

The profile of the flow channel 21' may be limited by what can be machined into the press tool, but could be semicircular, elliptical, triangular, rectangular etc. The flow channel 21' will typically have a width in the range of 0.5-1.0 mm. The velocity of the fluid flow will (at a given total flow rate) depend on the number and width of the flow channels 21'. The width of the flow channel may therefore vary depending on the relative placement of the heat exchanger chamber 30' within a step heat exchanger assembly, with the width increasing at lower temperatures to optimise the balance between viscous heating and fluid volume within the assembly. This further increases the thermal performance of the system.

Figure 12:
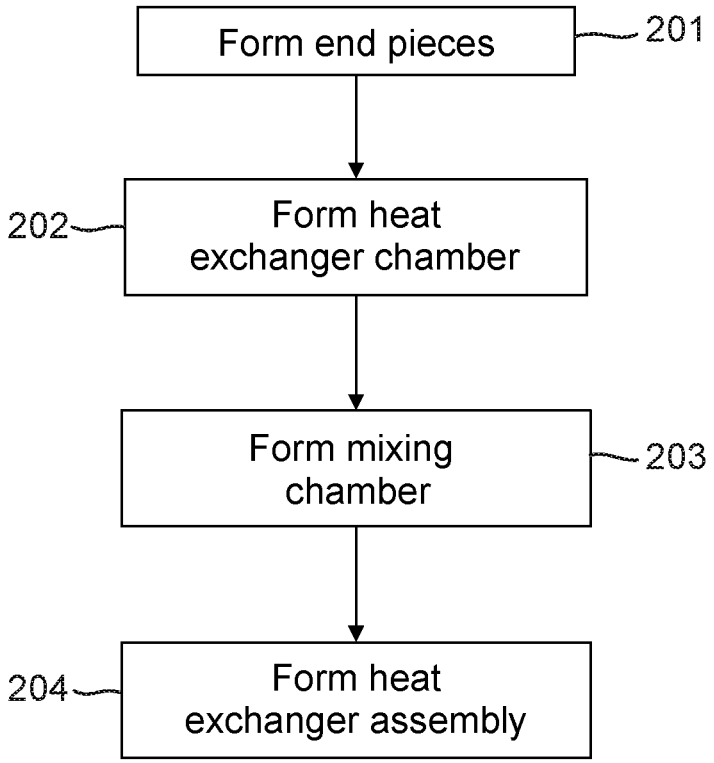
FIG. 12 is a flow chart illustrating a method according to an embodiment of the invention.
Figure 15:
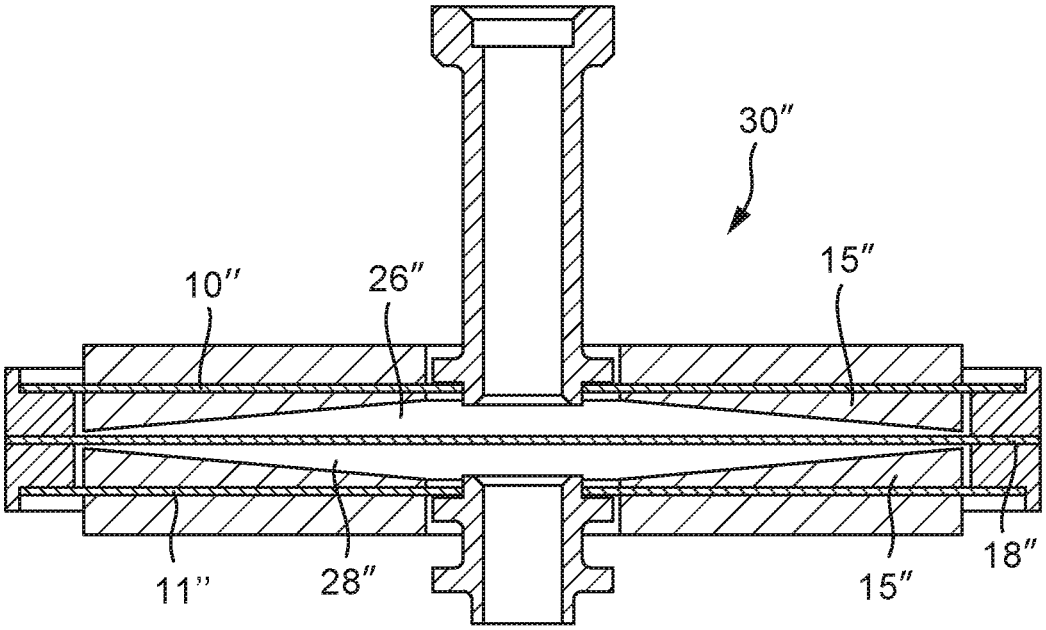
FIG. 15 is a cross-sectional illustration of a chamber forming part of a third embodiment of the invention.

In the first and second embodiments, the first and second regions within the chamber generally have a constant height in the direction across the plate (generally between 0.5 to 4 mm). Consequently, the fluid flow rate typically decreases as the fluid spreads radially outwards over a wider area. This may mean more viscous heating occurs towards the central axis, which can limit the performance of the cryogenic system in which the heat exchanger is installed. FIG. 15 illustrates parts of a heat exchanger according to a third embodiment of the invention. Double primed reference numerals are used to depict like components. The embodiment is similar to the first and second embodiments except that the sinter 15" on the inside of the chamber 30" is profiled so that the height of the first region 26" and second region 28" continually decreases at larger radiuses from the central axis. This profiling is achieved by pressing the sinter with a shaped tool in step 201 (FIG. 12). By profiling the sinter in this way, a 'deeper' flow channel is provided at smaller radiuses, which compensates the above effect and reduces any viscous heating. The maximum depth of the first region 26" and second region 28" is typically around 1.5 mm and the minimum depth is typically around 0.2 mm. The specific parameters may be varied, however, according to the operating temperature of the heat exchanger, for example as determined by its position in a stack of such heat exchangers.

Figure 16:
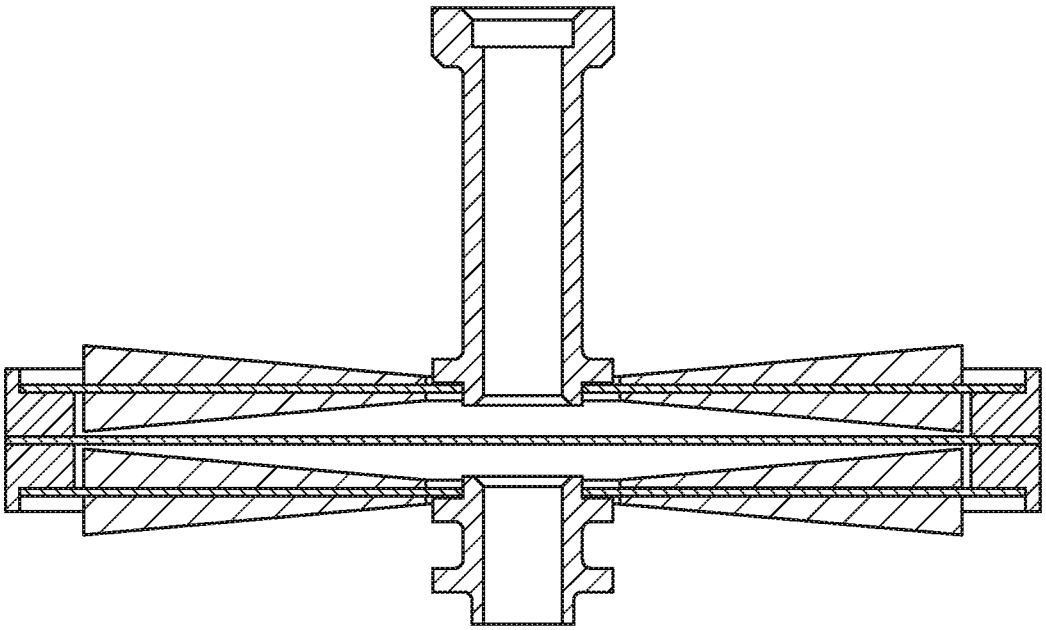
FIG. 16 is a cross-sectional illustration of a chamber forming part of a fourth embodiment of the invention.

In the example of FIG. 15 the sinter 15" applied to the opposing first major faces of the first and second foil members 10", 11" is profiled so that the thickness of sinter 15" linearly increases with the radius. In contrast, the thickness of the sinter 15" applied to the opposite second major faces of the first and second foil members 10", 11" remains generally constant. It should be remembered, however, that the sinter 15" on the outside of the chamber 30" is in contact with fluid conveyed along the second conduit surrounding the chamber (as shown by FIG. 10). In the context of a dilution refrigerator, this is typically the dilute phase of helium-3. Additional unwanted viscous heating can arise within the second conduit that may be mitigated by profiling the sinter applied to the second major faces of the first and second foil members 10", 11". This profiling is typically again performed so that the thickness of the sinter applied to the first and second foil members 10", 11" linearly increases with the radius. In practice one or both major surfaces of the first and second foil members may be profiled to control any viscous heating within the heat exchanger. FIG. 16 illustrates part of a heat exchanger according to a fourth embodiment in which both surfaces of the first and second foil are profiled to reduce any viscous heating and so improve the performance of the cryogenic cooling system in which the heat exchanger is installed. FIGS. 13-16 are not to scale but show examples of different shapes that can be pressed into the sinter to control the flow of the fluids through the heat exchanger.

An effective heat exchanger is thereby provided, operable at low temperatures and which ensures reliable operation of a cryogenic cooling system. The design of the heat exchanger has a relatively simple construction, which lends itself well to welding and automated manufacturing processes that can guarantee a high degree of repeatability in terms of thermal performance. Lower temperatures may therefore be obtained in cryogenic cooling systems such as dilution refrigerators incorporating the heat exchanger, where the lowest obtainable temperature is dependent on the performance of the heat exchanger. Such processes may also be used to speed up the time required to manufacture the cryogenic cooling systems.

The invention claimed is:

1. A heat exchanger for a cryogenic cooling apparatus, comprising:

a first conduit, a second conduit and a chamber, wherein the chamber is arranged to receive a fluid from the first conduit, and wherein the second conduit is thermally coupled to the outside of the chamber, the chamber having a first region and a second region, the first region separated from the second region by a plate extending through the chamber, the plate comprising one or more apertures for allowing a flow of the fluid from the first region to the second region;

wherein the chamber comprises a first end piece and a second end piece forming opposing sides of the chamber respectively, the first end piece coupled to the second end piece by a flow deflector, the flow deflector comprising a collar separating the first end piece from the second end piece, wherein the plate extends across the collar to form part of the flow deflector.

2. The heat exchanger according to claim 1, wherein one or both of the first end piece and the second end piece comprises;

a first face arranged inside the chamber, and a second face arranged outside the chamber and a foil member arranged between the first face and the second face, wherein the first face and the second face each comprise a sintered material applied to the foil member.

3. The heat exchanger according to claim 2, wherein a peripheral support member is arranged around the perimeter of each said foil member, the peripheral support member being fused to the collar.

4. The heat exchanger according to claim 3, wherein the thermal conductivity of the foil member and/or the sintered material is at least twenty times larger than that of the peripheral support member and/or the collar when at a temperature of 300 K.

5. The heat exchanger according to claim 2, wherein the heat exchanger comprises a central axis extending through the centre of the chamber, and wherein the first conduit is coupled to the chamber at two positions arranged along the central axis;

wherein the first face and/or the second face is profiled so that the thickness of the sinter on the foil member increases with the radial distance from the central axis.

6. The heat exchanger according to claim 2, wherein the heat exchanger comprises a central axis extending through the centre of the chamber, and wherein the first conduit is coupled to the chamber at two positions arranged along the central axis;

wherein the chamber defines a flow channel for conveying the fluid through the first region and the second region, and wherein the depth of the flow channel decreases with the radial distance from the central axis.

7. The heat exchanger according to claim 1, wherein the chamber defines a flow channel for conveying the fluid through the first region and the second region, wherein the flow channel is formed within a sinter applied to the first end piece and the second end piece.

8. A cryogenic cooling apparatus comprising:

a target refrigerator; and the heat exchanger according to claim 1, wherein the first conduit is arranged to convey an operational fluid to the target refrigerator and the second conduit is arranged to convey the operational fluid from the target refrigerator.

9. A dilution refrigerator comprising:

a still, a mixing chamber and the heat exchanger according to claim 1, wherein the first conduit is arranged to flow an operational fluid from the still to the mixing chamber and the second conduit is arranged to flow the operational fluid from the mixing chamber to the still, the heat exchanger configured to thermally couple the operational fluid in the first conduit with the operational fluid in the second conduit.

10. The dilution refrigerator according to claim 9, wherein;

the mixing chamber comprises a mass of sinter, the first conduit comprises an end portion that is open and extends around a portion of the mass of sinter so as to bring said portion of the mass of sinter into contact with the operational fluid, and the second conduit extends around the end portion and the mass of sinter so as to convey the operational fluid in a direction away from the mass of sinter.

11. The dilution refrigerator according to claim 9, further comprising a cold plate arranged between the still and the mixing chamber, wherein:

the cold plate is arranged to obtain a base temperature between that of the still and the mixing during operation of the dilution refrigerator, the dilution refrigerator further comprises a chamber assembly comprising one or more said chambers, each said chamber is arranged to receive the operational fluid from the first conduit, and said second conduit is thermally coupled to the outside of each said chamber.

12. The dilution refrigerator according to claim 11, wherein:

the chamber assembly comprises a first said chamber and a second said chamber, the first said chamber is arranged between the cold plate and the second said chamber, and the depth of the second said chamber and/or the number of apertures through the plate of the second said chamber or the size of the apertures through the plate of the second said chamber is higher than that of the first said chamber.

13. The dilution refrigerator according to claim 11, wherein;

each said chamber comprises one or more flow channels for conveying the fluid through the respective first region and the respective second region, each said flow channel is formed within a sinter, the chamber assembly is arranged along a thermal gradient during operation of the dilution refrigerator so that a first said chamber is arranged to obtain a higher base temperature than a second said chamber, and the diameter of the one or more flow channels in the first chamber is lower than the diameter of the one or more flow channels in the second chamber.

14. A method of forming a heat exchanger for a cryogenic refrigerator, the method comprising:

providing a first conduit, a second conduit, a first end piece, a second end piece and a flow deflector, the flow deflector comprising a collar and a plate, the plate extending across the collar;

wherein providing the first end piece comprises:

fusing a first peripheral support member around the perimeter of a first foil member, and then applying a sintered material to opposing faces of the first foil member, the thermal conductivity of the first peripheral support member being at least twenty times lower than that of the first foil member when at a temperature of 300 K; and fusing the first peripheral support member to the collar so as to form a chamber, the chamber having a first region separated from a second region by the plate, the plate arranged between the first end piece and the second end piece;

wherein the first conduit is arranged to convey a fluid into the first region and out from the second region;

wherein the plate comprises one or more apertures for allowing a flow of the fluid from the first region to the second region; and wherein the second conduit is thermally coupled to the outside of the chamber.

15. A dilution refrigerator comprising:

a still;

a mixing chamber;

a cold plate arranged between the still and the mixing chamber, the cold plate arranged to obtain a base temperature between that of the still and the mixing chamber during operation of the dilution refrigerator;

a first conduit arranged to flow an operational fluid from the still to the mixing chamber;

a second conduit is arranged to flow the operational fluid from the mixing chamber to the still; and a heat exchanger assembly comprising one or more heat exchangers arranged along a portion of the first conduit, the one or more heat exchangers extending between the cold plate and the mixing chamber;

wherein each said heat exchanger comprises:

a chamber arranged to receive the operational fluid from the first conduit, wherein the second conduit is thermally coupled to the outside of the chamber, the chamber having a first region and a second region, the first region separated from the second region by a plate extending through the chamber, the plate comprising one or more apertures for allowing a flow of the fluid from the first region to the second region, the heat exchanger configured to thermally couple the operational fluid in the first conduit with the operational fluid in the second conduit, and wherein each said chamber comprises a first end piece and a second end piece forming opposing sides of the chamber respectively, the first end piece coupled to the second end piece by a flow deflector, the flow deflector comprising a collar separating the first end piece from the second end piece, wherein the plate extends across the collar to form part of the flow deflector.

16. The dilution refrigerator according to claim 15, wherein the mixing chamber comprises a mass of sinter, and the first conduit comprises an end portion that is open and extends around a portion of the mass of sinter so as to bring said portion of the mass of sinter into contact with the operational fluid, the second conduit extending around the end portion and the mass of sinter so as to convey the operational fluid in a direction away from the mass of sinter.

17. The dilution refrigerator according to claim 15, wherein a said heat exchanger is arranged to obtain a temperature below 30 mK in use.

18. The dilution refrigerator according to claim 15, wherein the heat exchanger assembly comprises a first said heat exchanger and a second said heat exchanger, the first said heat exchanger being arranged between the cold plate and the second said heat exchanger, wherein the depth of the chamber of the second said heat exchanger and/or the number of apertures through the plate of the second said heat exchanger or the size of the apertures through the plate of the second said heat exchanger is higher than that of the first said heat exchanger.

19. The dilution refrigerator according to claim 15, wherein each said chamber comprises one or more flow channels for conveying the fluid through the respective first region and the respective second region, wherein each said flow channel is formed within a sinter, wherein the heat exchanger assembly is arranged along a thermal gradient during operation of the dilution refrigerator so that a first said heat exchanger is arranged to obtain a higher base temperature than a second said heat exchanger, and wherein the diameter of the one or more flow channels in the first heat exchanger is lower than the diameter of the one or more flow channels in the second heat exchanger.

20. A dilution refrigerator comprising:

a still, a mixing chamber and a heat exchanger, wherein the heat exchanger comprises:

a first conduit, a second conduit and a chamber, wherein the first conduit is arranged to flow an operational fluid from the still to the mixing chamber and the second conduit is arranged to flow the operational fluid from the mixing chamber to the still, the heat exchanger configured to thermally couple the operational fluid in the first conduit with the operational fluid in the second conduit; wherein the second conduit forms the exterior of the heat exchanger, wherein the chamber is arranged to receive the operational fluid from the first conduit, and wherein second conduit is thermally coupled to the outside of the chamber, the chamber having a first region and a second region, the first region separated from the second region by a plate extending through the chamber, the plate comprising one or more apertures for allowing a flow of the operational fluid from the first region to the second region, and wherein said chamber comprises a first end piece and a second end piece forming opposing sides of the chamber respectively, the first end piece coupled to the second end piece by a flow deflector, the flow deflector comprising a collar separating the first end piece from the second end piece, wherein the plate extends across the collar to form part of the flow deflector.

21. The dilution refrigerator according to claim 20, wherein the first conduit and/or the second conduit is formed from a plurality of modules that are fused together.

* * * * *